US007314397B2

(12) United States Patent
Sodemann et al.

(10) Patent No.: US 7,314,397 B2
(45) Date of Patent: Jan. 1, 2008

(54) STANDBY GENERATOR

(75) Inventors: Wesley C. Sodemann, Dousman, WI (US); Billy Brandenburg, Horicon, WI (US); Peter Nushart, Waukesha, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 11/417,741

(22) Filed: May 4, 2006

(65) Prior Publication Data

US 2006/0258237 A1 Nov. 16, 2006

Related U.S. Application Data

(60) Provisional application No. 60/680,622, filed on May 13, 2005.

(51) Int. Cl.
*B63H 21/00* (2006.01)

(52) U.S. Cl. ..... 440/89 R; 60/321; 123/41.7

(58) Field of Classification Search ..... 440/89 R, 440/89 C; 60/320, 321, 323; 123/2, 41.7
See application file for complete search history.

(56) References Cited

U.S. PATENT DOCUMENTS 3,968,649 A * 7/1976 Edwards ..... 60/320
4,243,893 A 1/1981 Sten
4,540,888 A 9/1985 Drewry et al.
4,548,164 A 10/1985 Ylonen et al.
4,677,940 A 7/1987 Bracht et al.
4,779,905 A 10/1988 Ito et al.
4,856,470 A 8/1989 Ishii et al.
4,859,886 A 8/1989 Tanaka et al.
4,907,546 A 3/1990 Ishii et al.
5,121,715 A 6/1992 Nogami et al.
5,133,637 A 7/1992 Wadsworth
5,433,175 A 7/1995 Hughes et al.
5,515,816 A 5/1996 Ball et al.
5,546,901 A 8/1996 Acker et al.
5,556,314 A * 9/1996 Fukuda et al. ..... 440/89 R
5,626,105 A 5/1997 Locke et al.
5,694,889 A 12/1997 Ball et al.
5,890,460 A 4/1999 Ball et al.
5,899,174 A 5/1999 Anderson et al.
5,965,999 A 10/1999 Frank
D418,809 S 1/2000 Frank
6,067,945 A 5/2000 Fukuda et al.

(Continued)

FOREIGN PATENT DOCUMENTS

JP 63056144 3/1988

(Continued)

*Primary Examiner*—Lars A. Olson
(74) *Attorney, Agent, or Firm*—Michael Best & Friedrich LLP

(57) ABSTRACT

An exhaust system for an engine that produces an exhaust gas during operation. The exhaust system includes a manifold in fluid communication with the engine to receive the exhaust gas and a conduit extending from the manifold in a first direction. An outlet manifold is coupled to the conduit and extends in a second direction substantially normal to the first direction. The outlet manifold defines an aperture oriented such that exhaust gas passes through the aperture and out of the outlet manifold in a third direction that is substantially opposite the first direction.

26 Claims, 9 Drawing Sheets

U.S. PATENT DOCUMENTS

| | | | | |
|---|---|---|---|---|
| 6,084,313 | A | 7/2000 | Frank | |
| 6,095,099 | A | 8/2000 | Morohoshi et al. | |
| 6,134,878 | A | 10/2000 | Amako et al. | |
| 6,181,019 | B1 | 1/2001 | Frank | |
| 6,310,404 | B1 | 10/2001 | Frank | |
| 6,313,543 | B1 | 11/2001 | Frank | |
| 6,376,944 | B1 | 4/2002 | Grizzle, Jr. et al. | |
| 6,431,126 | B2 | 8/2002 | Saito | |
| 6,492,740 | B2 | 12/2002 | Suzuki | |
| 6,499,441 | B2 | 12/2002 | Suzuki | |
| 6,568,355 | B2 | 5/2003 | Suzuki | |
| 7,004,805 | B2 * | 2/2006 | Lee et al. | 440/89 R |
| 2003/0011196 | A1 | 1/2003 | Kern et al. | |

FOREIGN PATENT DOCUMENTS

| | | |
|---|---|---|
| JP | 5312050 | 11/1993 |
| JP | 11082044 | 3/1999 |

* cited by examiner

STANDBY GENERATOR

RELATED APPLICATION DATA

This application claims priority to co-pending U.S. Provisional Patent Application Ser. No. 60/680,622 filed on May 13, 2005, the contents of which are fully incorporated herein by reference.

BACKGROUND

The present invention relates to a standby generator. More particularly, the invention relates to the arrangement of the components of a standby generator within an enclosure that improves cooling and reduces noise levels.

Standby generators have become popular as sources of limited amounts of power for short-term use. For example, standby generators are often connected to homes or businesses to provide power in situations where the normal power source (e.g., utility power grid) fails.

Standby generators generally include a prime mover that provides mechanical power to a generator or alternator that includes a rotor that rotates to generate useable electricity. The electricity is delivered via a switch, breaker, or other interruptible device to the home, business, or facility for use.

SUMMARY

The present invention provides a standby electrical power generator that includes a prime mover, an alternator, and an enclosure containing the prime mover and the alternator. In preferred constructions, the prime mover includes an internal combustion engine or fuel cell. The engine and the alternator are arranged such that the alternator draws in a supply of cooling air from outside of the enclosure and the engine draws in a supply of cooling air and combustion air from outside of the enclosure. The combustion air flows through the engine where it is mixed with fuel and combusted to form a flow of combustion byproducts, or exhaust. The exhaust flows into an exhaust manifold and then out an elongated tube that redirects the exhaust such that the exhaust exits the tube in a first direction toward the exhaust manifold. The engine cooling air and the alternator cooling air pass over the exhaust manifold and flow in a second direction that is generally opposite the first direction. The exhaust mixes with the two cooling flows and the flow direction of the exhaust again reverses as the air and exhaust flow out of the enclosure.

In one embodiment, the invention provides an exhaust system for an engine that produces an exhaust gas during operation. The exhaust system includes a manifold in fluid communication with the engine to receive the exhaust gas and a conduit extending from the manifold in a first direction. An outlet manifold is coupled to the conduit and extends in a second direction substantially normal to the first direction. The outlet manifold defines an aperture oriented such that exhaust gas passes through the aperture and out of the outlet manifold in a third direction that is substantially opposite the first direction.

In another embodiment, the invention provides an apparatus that includes an enclosure having a first aperture and a second aperture. A prime mover is disposed within the enclosure and is operable to discharge exhaust gas and to draw a flow of air into the enclosure through the first aperture. A manifold is in fluid communication with the prime mover to receive the flow of exhaust gas. The manifold is positioned such that a portion of the flow of air flows over the manifold in a first direction. An outlet manifold is in fluid communication with the manifold and defines an outlet aperture oriented such that exhaust gas passes through the outlet aperture and out of the outlet manifold in a second direction that is substantially opposite the first direction.

In another embodiment, the invention provides a method of operating an engine in an enclosure. The method includes operating the engine to draw in a flow of air and to produce a flow of exhaust gas and collecting the flow of exhaust gas within a manifold. The method also includes passing at least a portion of the flow of air over the manifold in a first direction, directing the flow of exhaust gas to an outlet manifold, and discharging the flow of exhaust gas from the outlet manifold in a second direction substantially opposite the first direction. The method further includes mixing a portion of the flow of exhaust gas with a portion of the flow of air to define a mixture and discharging the mixture from the enclosure.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
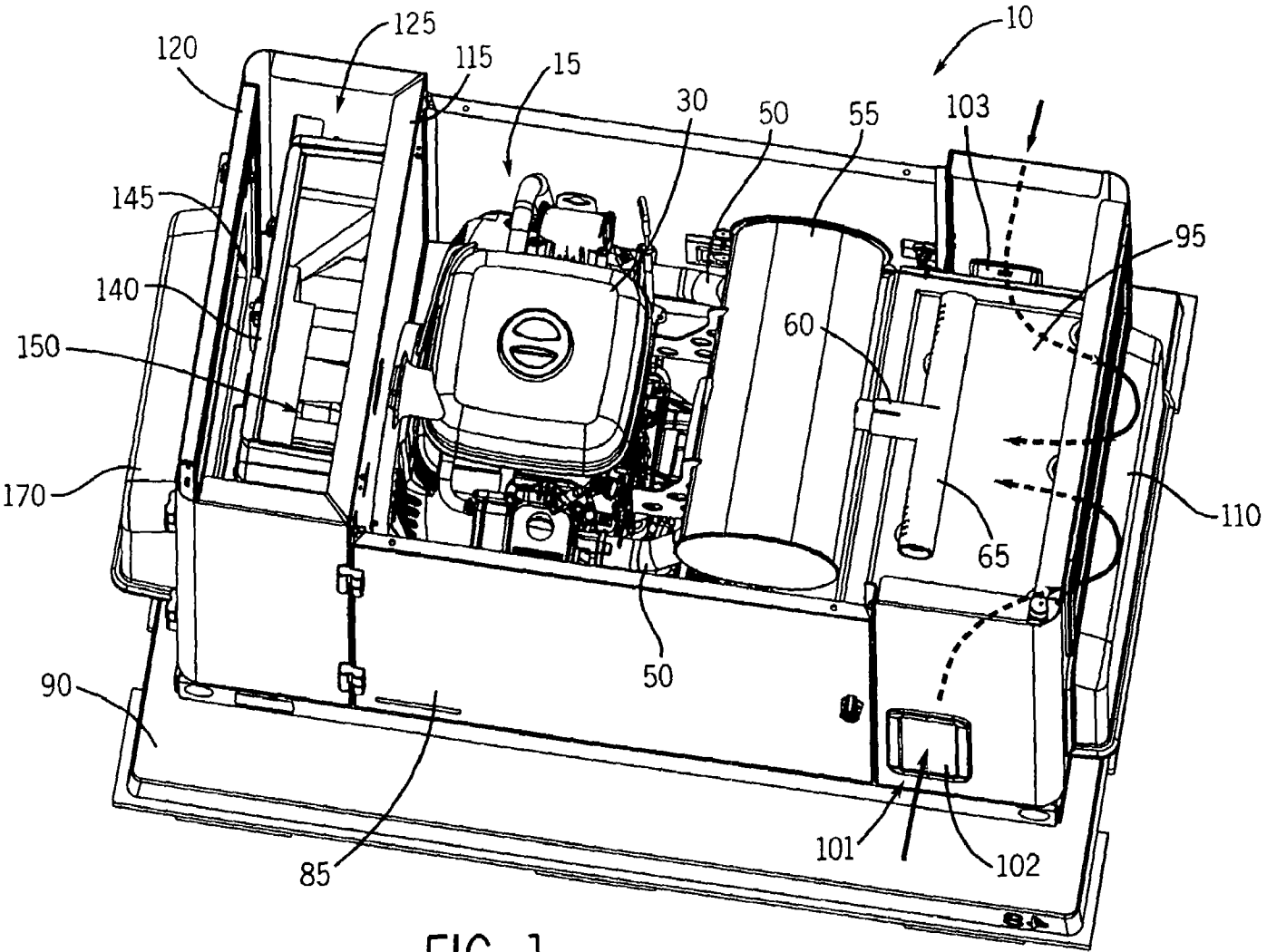
FIG. 1 is a perspective view of a standby generator with a portion of the enclosure removed.
Figure 2:
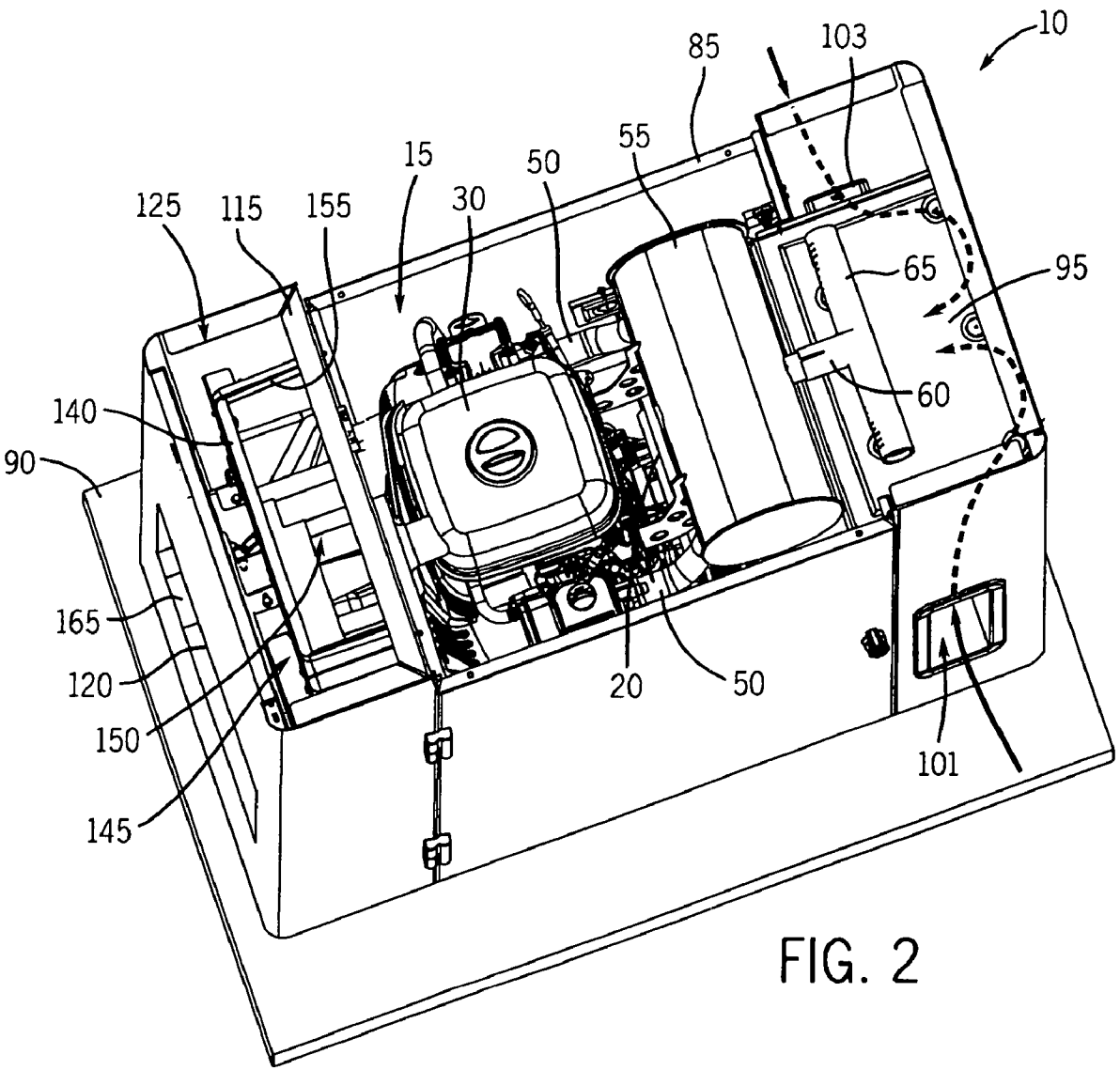
FIG. 2 is another perspective view of a standby generator with a portion of the enclosure removed.
Figure 8:
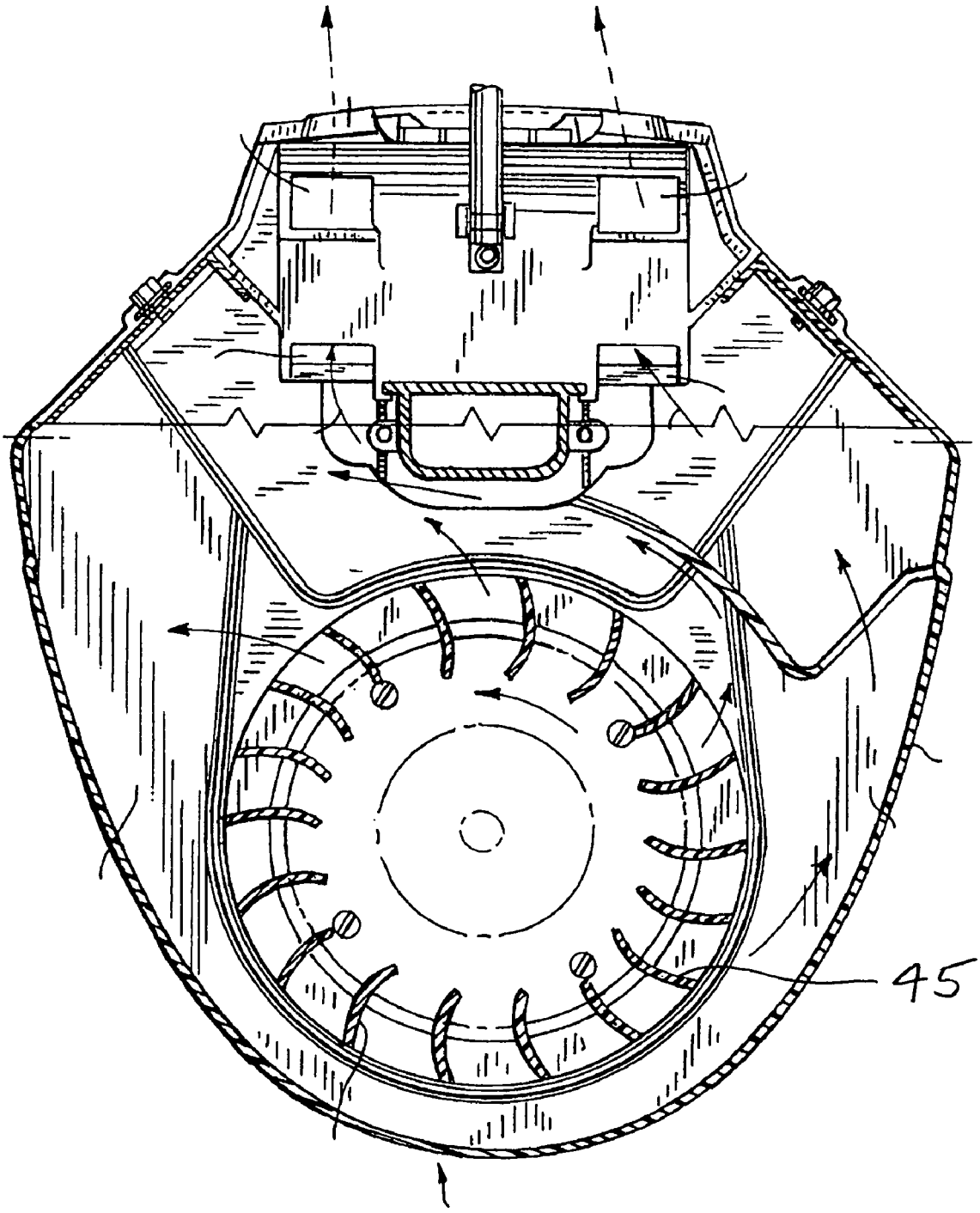
FIG. 8 is a section view of the engine of FIG. 3 taken along line 8-8 of FIG. 3.
Figure 9:
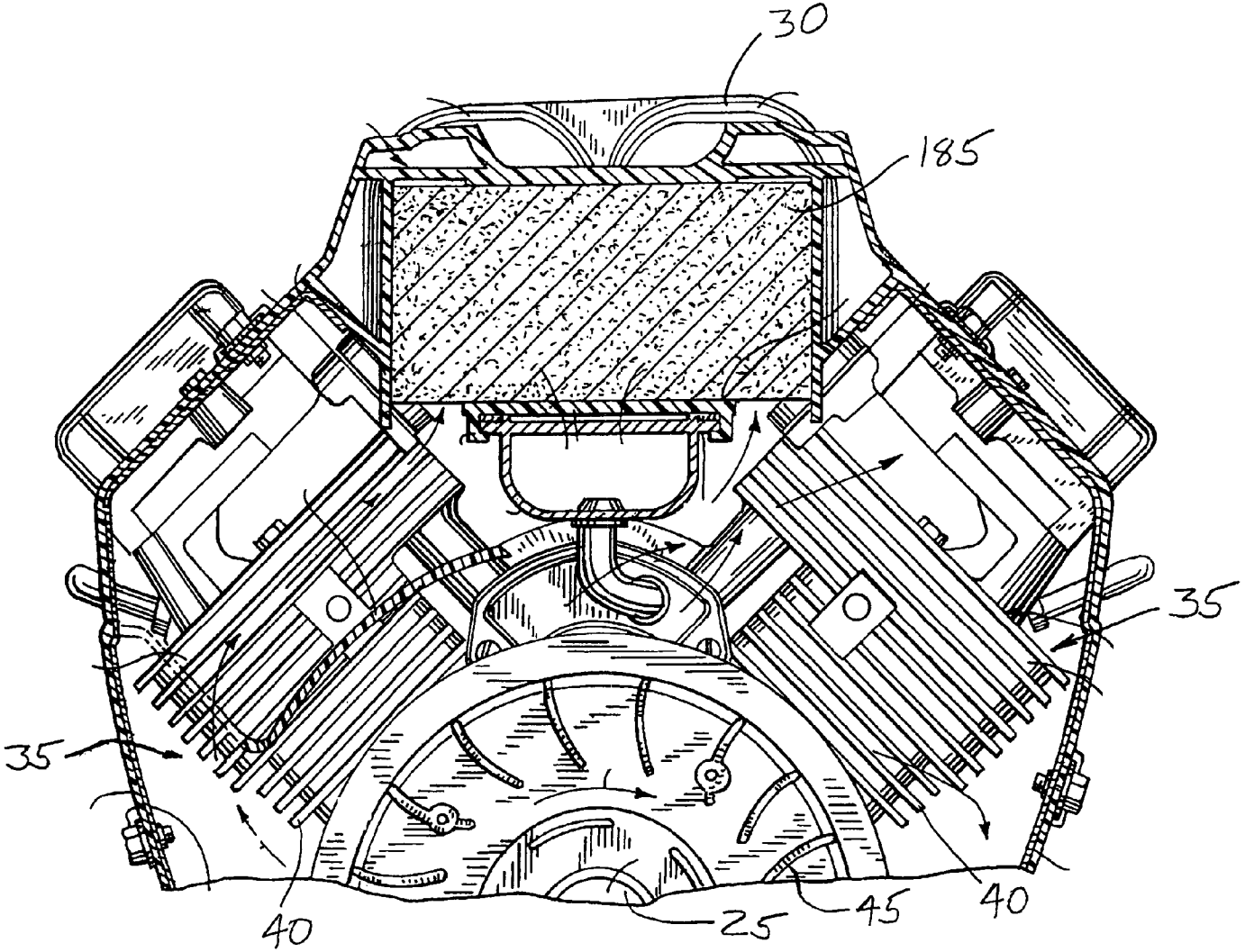
FIG. 9 is a front view of a portion of the engine of FIG. 1.

FIG. 1 illustrates a standby generator 10 that is suited for use in providing electrical power. The standby generator 10 includes a prime mover such as an internal combustion engine 15, a diesel engine, a rotary engine, or the like, and an alternator 20. The construction illustrated in FIGS. 1-4 includes a two-cylinder internal combustion engine 15 that includes an output shaft 25. The engine 15, illustrated in FIGS. 8 and 9, is arranged such that the output shaft 25 extends substantially horizontally. Of course other constructions may employ other engines or other engine arrangements. For example, other constructions may employ a vertical shaft engine that may be coupled to a gearbox or may be directly coupled to the alternator 20. Still other constructions may employ single-cylinder engines or engines with three or more cylinders.

The engine includes an air-fuel mixing device (not shown), such as a carburetor, and an air cleaner 30 positioned to filter particulate matter from an air stream before the air is directed to the air-fuel mixing device. Of course, other construction may employ other fuel mixing devices such as fuel injection without affecting the function of the invention.

The illustrated engine 15 is an air-cooled engine such as the engine shown and described in U.S. Pat. Nos. 5,813,384 and 6,889,635 the contents of which are fully incorporated herein by reference. Liquid-cooled engines may also be suitable for use in standby generators 10 if desired. With a liquid cooled engine, air that would normally pass over the engine for cooling, passes through a radiator or other heat exchanger. As noted, the engine 15 includes two cylinders 35 with each cylinder 35 including a plurality of fins 40 that improve the cooling efficiency of the engine 15. As with most air-cooled engines, the illustrated engine 15 includes a fan portion 45 that is coupled to the output shaft 25 such that the fan 45 rotates with the engine output shaft 25 when the engine 15 is operating. The fan 45 is positioned to draw in air and direct that air past the engine cylinders 35 and other engine components to provide the desired cooling for the engine 15.

Turning to FIGS. 1-4, the engine 15 also includes exhaust tubes 50 that extend from each of the cylinders 35 to an exhaust manifold 55, or muffler. The tubes 50 guide hot byproducts of combustion or exhaust produced within the engine 15 during combustion from the cylinders 35 to the exhaust manifold 55. The exhaust manifold 55 is a large cylindrical member having a substantially elliptical cross-section that defines an internal volume. The exhaust manifold 55 is sized to receive the engine exhaust and functions to reduce the flow velocity of the exhaust by providing an increased flow area when compared to the flow area of the tubes 50. In some constructions, the exhaust manifold 55 may include baffles 57 (shown in FIGS. 6 and 7) or other flow diverting devices disposed within the internal volume to redirect and slow the flow to reduce the noise produced during operation. In such arrangements, the exhaust manifold 55 functions in much the same way as a muffler. A first tube 60 (sometimes referred to as an outlet manifold) extends rearward from the exhaust manifold 55 and attaches to a second tube 65. The second tube 65 extends substantially perpendicular to the first tube 60 and includes a plurality of small apertures 70 spaced along the length of the tube 65 that allow for the escape of the engine exhaust. The apertures 70 are positioned on the side of the second tube 65 nearest the exhaust manifold 55 such that the exhaust flows in a first direction 75 that is generally from the rear of the standby generator 10 toward the front of the standby generator 10.

Figure 3:
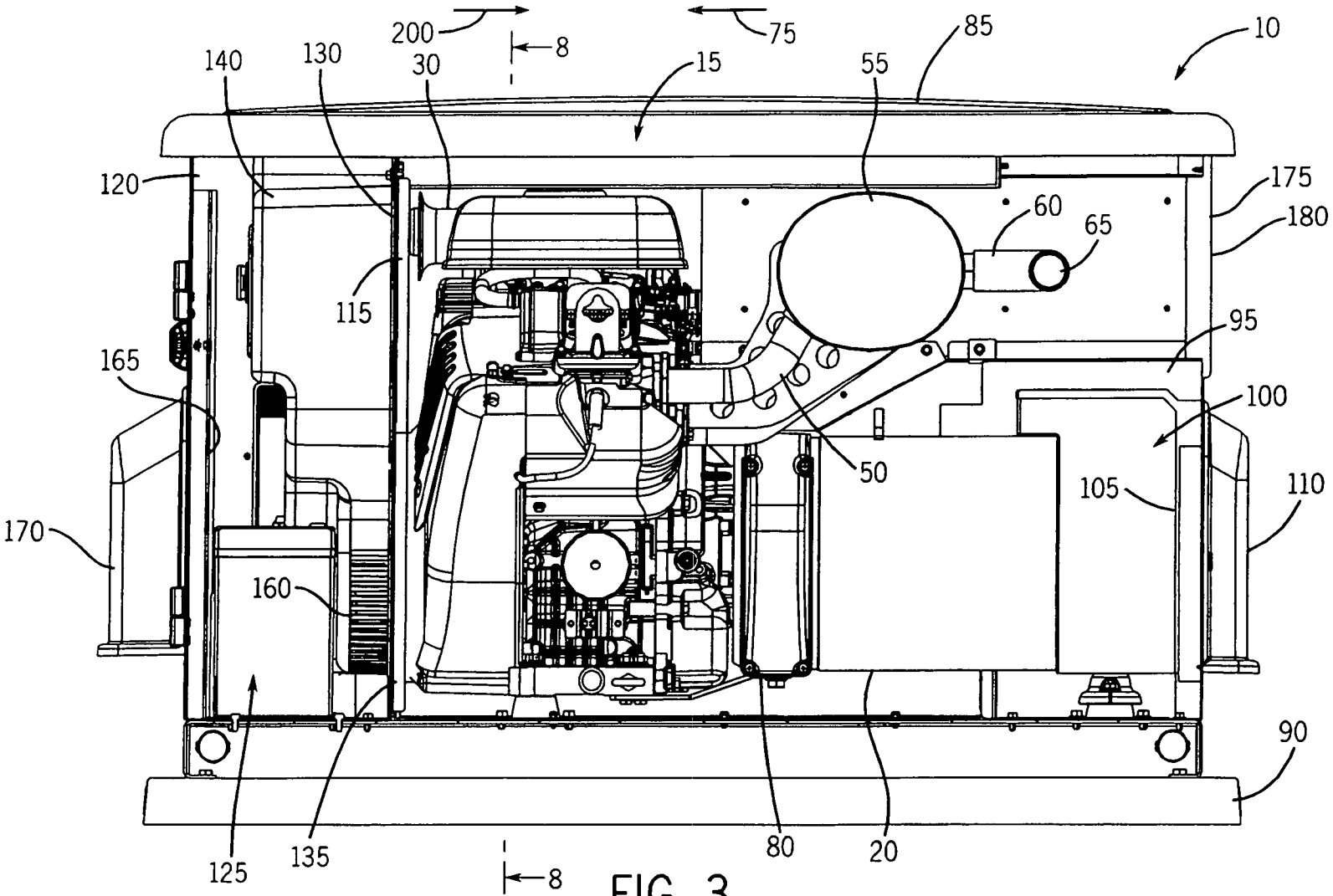
FIG. 3 is a side view of the standby generator of FIG. 1 with a portion of the enclosure removed.
Figure 4:
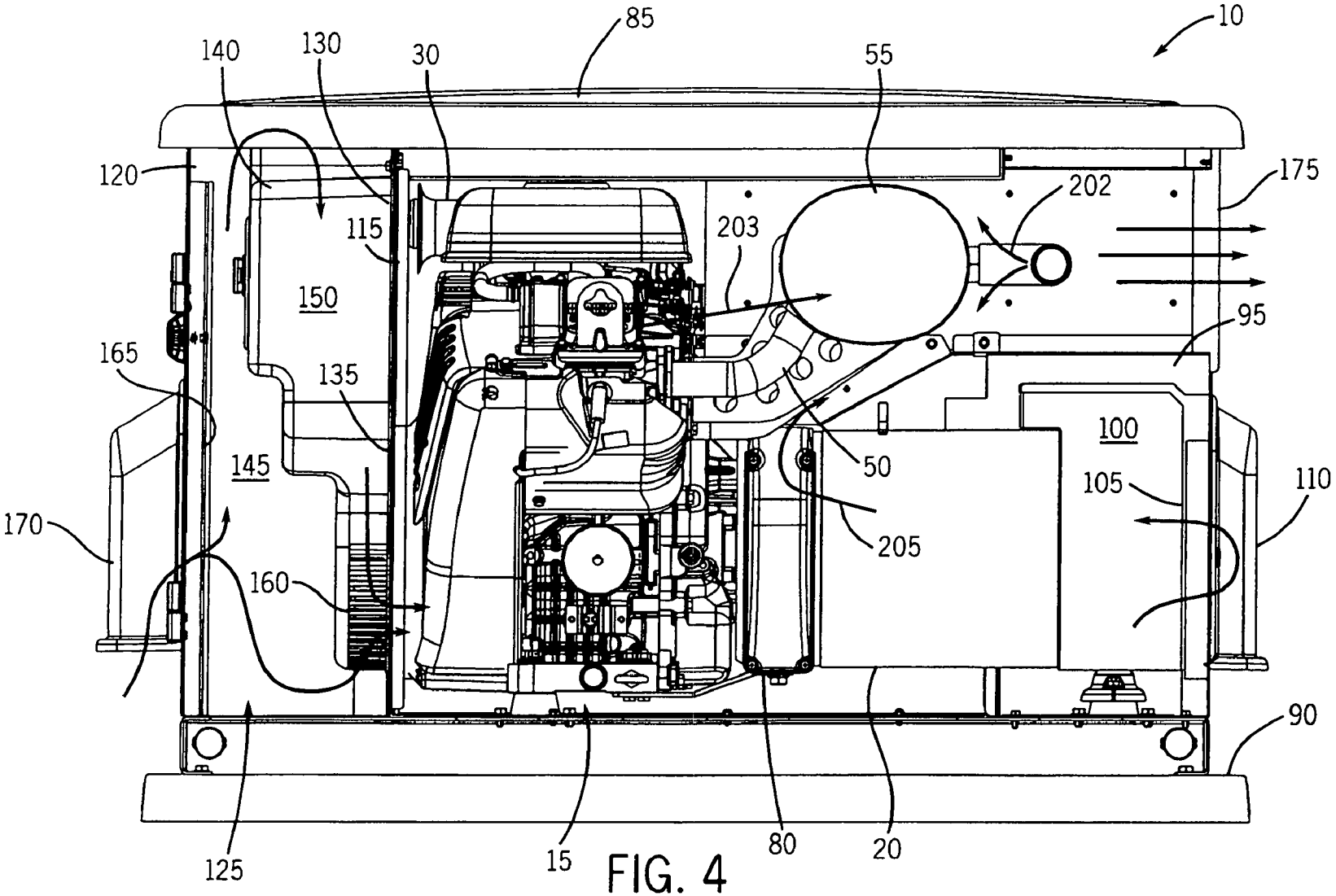
FIG. 4 is another side view of the standby generator of FIG. 1 with a portion of the enclosure removed and illustrating the air flow paths.
Figure 5:
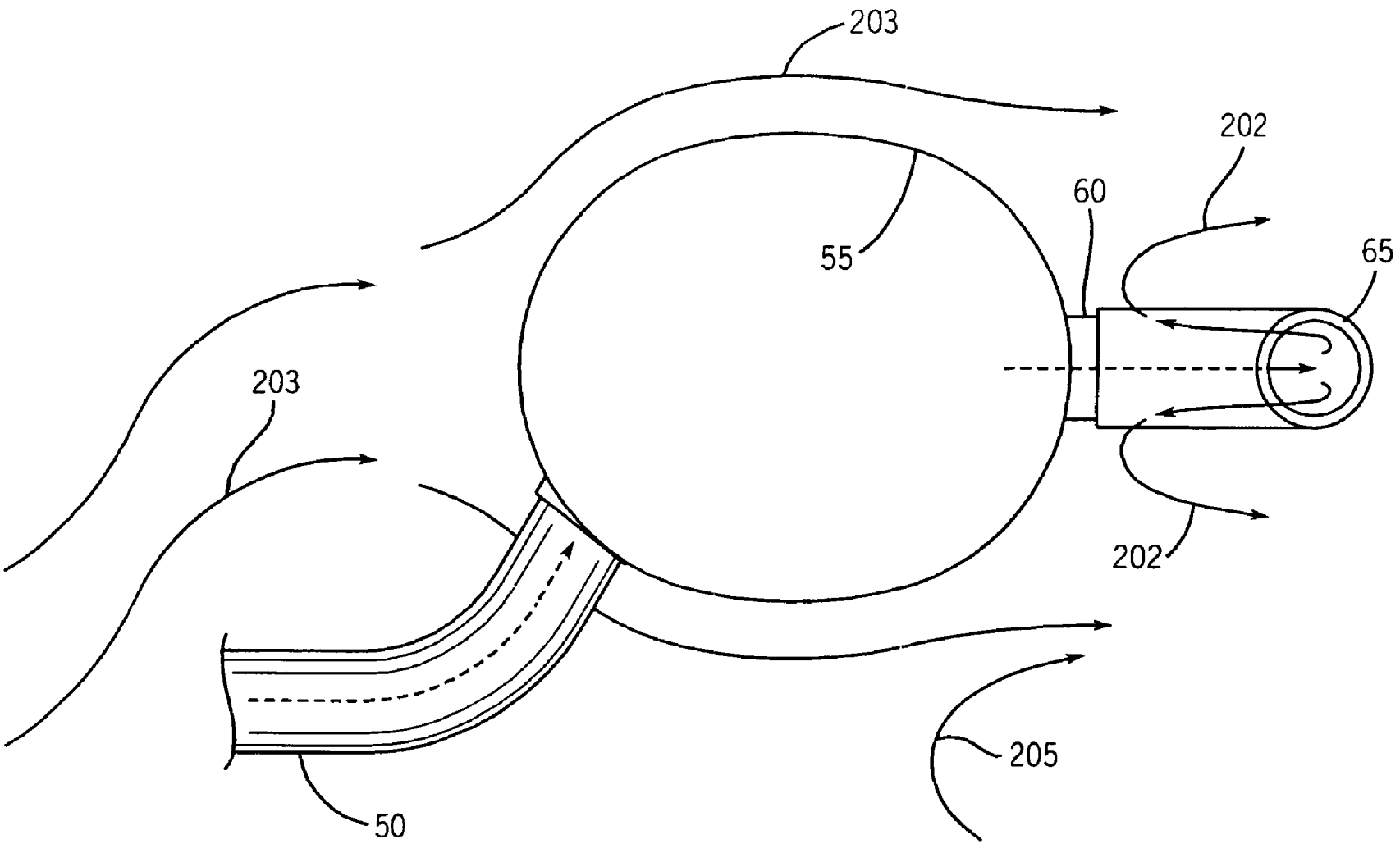
FIG. 5 is a side schematic illustration of a portion of the standby generator illustrating the air flow paths.

Turning to FIG. 3, the alternator 20 of the standby generator 10 includes an alternator shaft (not shown). The alternator shaft connects with the output shaft 25 of the engine 15 such that the alternator shaft rotates with the output shaft 25. The alternator 20 extends rearward under the exhaust manifold 55, the first tube 60, and the second tube 65. As discussed, most constructions employ an alternator that generates usable electricity (e.g., 60 hertz). However, other constructions may employ asynchronous alternators, inverters, synchronous or other electrical devices suited to converting rotating mechanical power to electrical power at a desired voltage and frequency.

In preferred constructions, the alternator 20 includes a fan 80 that is coupled to the alternator shaft such that the fan 80 rotates with the alternator shaft. The alternator 20 also includes, or at least partially defines, one or more passages (not shown) that extend through at least a portion of the alternator 20. The passages provide flow paths for air that in turn cools the alternator 20 during alternator operation. The fan 80 draws air into the alternator 20 and through the passages. While many constructions of alternators 20 are available, the illustrated construction is arranged such that the fan 80 is adjacent the front portion of the alternator 20 and is operable to draw air from the rear portion of the alternator 20. The air flows through the passages and exits the front of the alternator 20 adjacent the fan 80. Other constructions may position the fan 80 near the rear of the alternator 20 to push the air through the alternator passages to the front of the alternator 20 where the air would be discharged. Still other constructions may position the fan 80 near the rear of the alternator 20 to pull air from the front to the rear, or may position the fan 80 near the front of the alternator 20 to push air to the rear. While many fan arrangements are possible, the preferred arrangements move air from the rear of the alternator 20 to the front of the alternator 20, as illustrated in FIGS. 1-4.

The engine 15, exhaust manifold 55, first tube 60, second tube 65, and alternator 20 are all substantially contained within an enclosure 85. In preferred constructions, the size of the enclosure 85 is as small as possible to reduce the visual impact of the standby generator 10. Generally, it is desirable that the standby generator 10 be as small and as quiet as possible. The enclosure 85 generally rests on a support structure such as a concrete slab 90, as illustrated in FIG. 3. In some constructions, a fuel tank (not shown) is disposed within the enclosure 85 with other constructions locating the fuel tank outside of the enclosure 85. If the fuel is natural gas or the like, the fuel may be supplied via a gas line.

The enclosure 85 includes a number of openings, apertures, or channels that allow for the entry and exit of air that is used for cooling, as well as for combustion. The arrangement of the components within the enclosure 85 is such that the cooling effect of the air flow through the engine 15 is increased. In addition, the air flow paths are arranged to reduce the noise of the standby generator 10 during operation.

Figure 10:
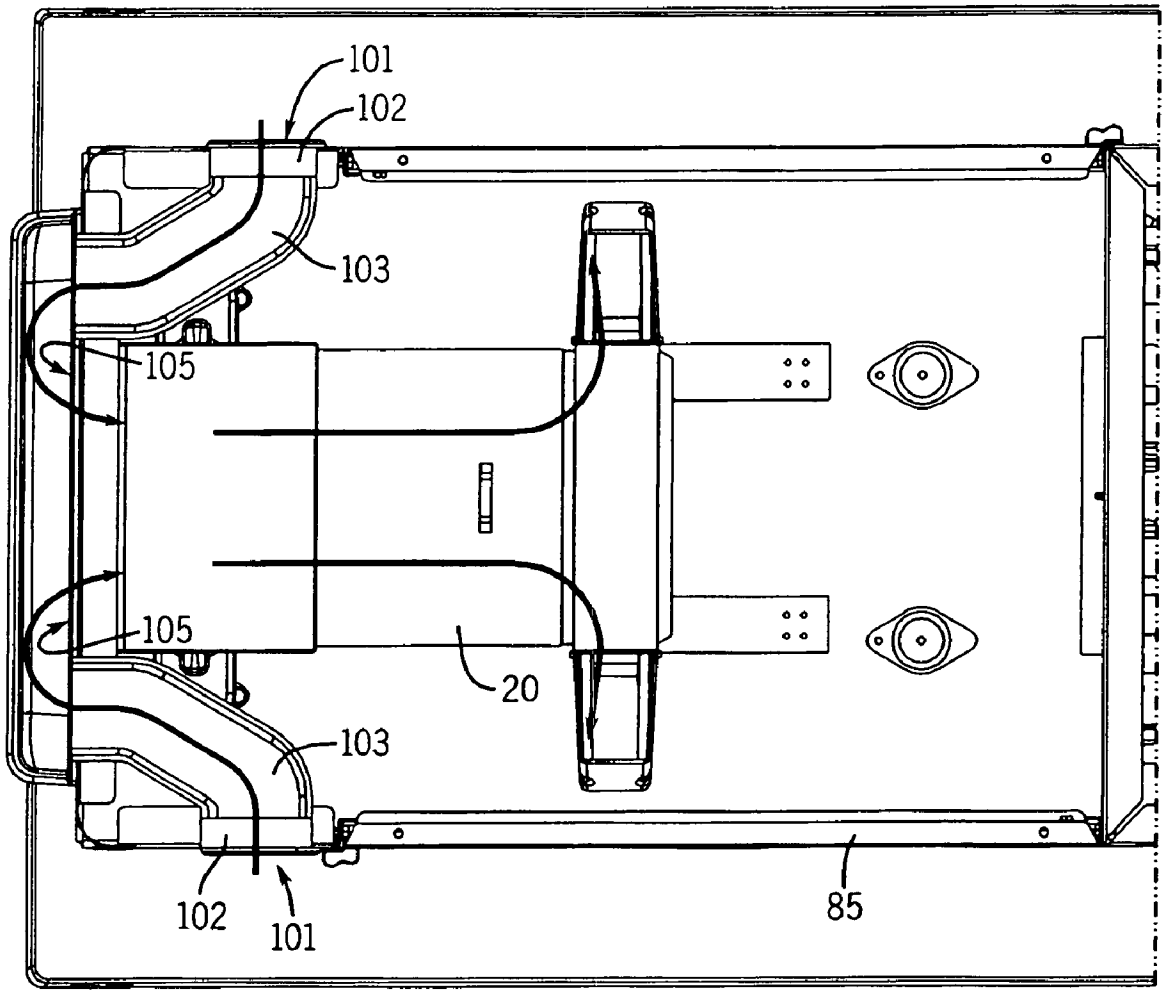
FIG. 10 is a top view of the engine with a portion of the enclosure removed and illustrating some of the air flow paths.

With continued reference to FIG. 3, the rear portion of the alternator 20 is disposed at least partially within an inner housing 95 that is disposed within the enclosure 85. The inner housing 95 cooperates with the enclosure 85 to define an alternator space 100. As is best illustrated in FIG. 10, a pair of intake apertures 101 are formed as part of the enclosure 85 adjacent the space 100 to provide a portion of a flow path between the exterior of the enclosure 85 and the space 100. Louver panels 102 or other aperture covers cover the apertures 101 and inhibit the entry of large particles such as rocks, sticks, and other debris. Rubber ducts 103 guide the air from the intake apertures 101 to a duct cover 110. From the duct cover 110, the air passes through an aperture 105 into the space 100 adjacent the rear portion of the alternator 20.

A wall 115 is positioned between the engine 15 and a front panel 120 of the enclosure 85 to at least partially define an engine chamber 125. The wall 115 includes two apertures 130, 135 that direct air from the engine chamber 125 to the engine 15. The uppermost aperture 130 directs air from the engine chamber 125 to the air cleaner 30, while the lowermost aperture 135 directs air from the engine chamber 125 to the engine fan 45.

An air duct 140 is disposed substantially within the engine chamber 125 and is coupled to the wall 115 such that the air duct 140 at least partially surrounds the two apertures 130, 135 in the wall 115, and partially separates the engine chamber 125 into an inlet space 145 and an air duct space 150. The air duct 140 includes an opening 155 near its top that allows air to pass from the inlet space 145 to the air duct space 150. In addition, several slots 160 are formed in the air duct 140 near its lower end to allow additional air to flow from the inlet space 145 to the air duct space 150.

The front panel 120 of the enclosure 85 includes an engine aperture 165 that provides fluid communication between the exterior of the enclosure 85 and the engine chamber 125. A duct cover 170 is placed or formed over the engine aperture 165 to inhibit the entry of large particles and to force the air to enter the enclosure 85 along a substantially vertical path. As with the duct cover 110, other covers, such as louvers or grates may be used to cover the engine aperture 165 and inhibit the entry of large unwanted particles.

The enclosure 85 also defines an outlet aperture 175 near the rear of the enclosure 85. The outlet aperture 175 allows for the escape of air from the enclosure 85. In most constructions, an outlet grate 180, louvers, or another device that inhibits the entry or exit of large particles covers the outlet aperture 175.

During operation of the standby generator 10, air is drawn into the enclosure 85 through the engine aperture 165 and the intake apertures 105 and is discharged through the outlet aperture 175. The remainder of the enclosure 85 is substantially sealed to inhibit unwanted air flow paths.

The engine 15 draws air from the engine chamber 125 in two ways. First, the engine 15, and more specifically the air-fuel mixing device, draws air from the engine chamber 125 for combustion. Generally, the engine 15 draws air from the engine chamber 125 through the open top portion 155 of the air duct 140 and the lower slots 160 and directs the air into the air cleaner 30. The air cleaner 30 supports a filter element 185 that filters the air to remove unwanted particles before the air is delivered to the fuel-air mixing device where the air and fuel mix to produce a combustible mixture. A portion of the combustible mixture flows to each of the cylinders 35 where it is combusted to produce usable power at the output shaft 25 and the flow of engine exhaust. The engine exhaust exits each cylinder 35 through the exhaust tubes 50 and flows to the exhaust manifold 55. From the exhaust manifold 55, the engine exhaust flows to the first tube 60, and ultimately to the second tube 65 and out of the second tube 65. As discussed, the second tube 65 includes apertures 70 that direct the engine exhaust towards the exhaust manifold 55.

Figure 6:
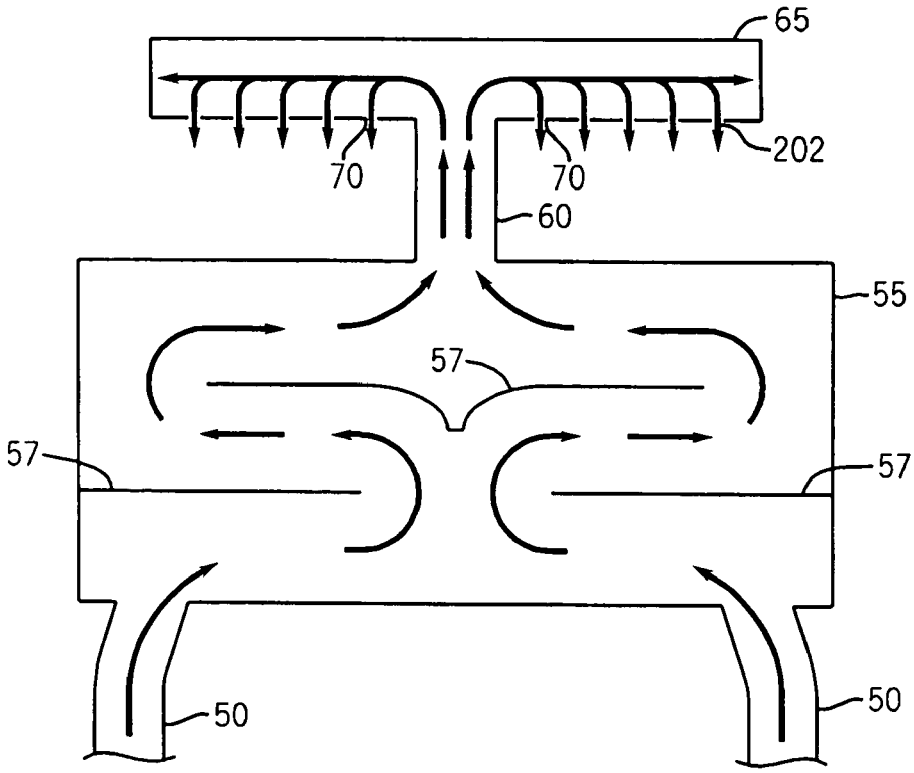
FIG. 6 is a top schematic illustration of a portion of the standby generator illustrating the air flow paths within the exhaust manifold.
Figure 7:
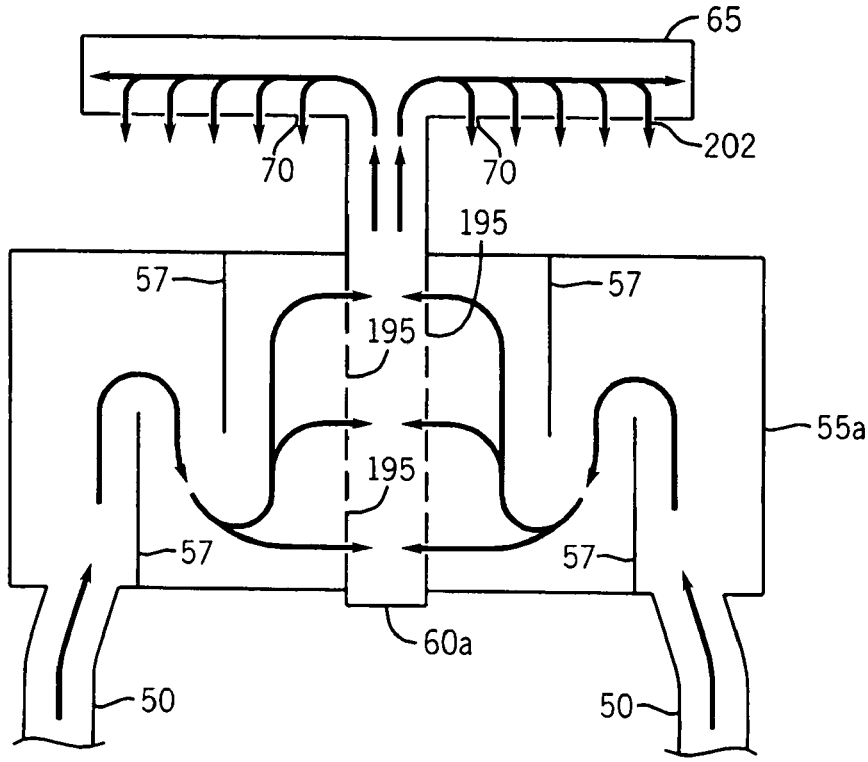
FIG. 7 is a top schematic illustration of a portion of the standby generator including an alternative exhaust manifold and illustrating the fluid flow paths within the alternative exhaust manifold.

FIGS. 6 and 7 schematically illustrate two possible flow paths that could be followed by the engine exhaust as the exhaust leaves the engine cylinders 35. The exhaust travels through the exhaust tubes 50 between the cylinders 35 and the exhaust manifold 55. The exhaust tubes 50 are substantially uniform in direction and do not include significant direction changes.

Baffles 57 may be positioned within the exhaust manifold 55 to force the engine exhaust to follow a circuitous flow path through the exhaust manifold 55. In the construction illustrated in FIG. 6, the flow divides into two separate flows that enter the exhaust manifold 55 and turn inward along two flow paths that are substantially perpendicular to the direction at which the exhaust enters the exhaust manifold 55. The flows then substantially reverse direction twice before reaching the outlet of the exhaust manifold 55. Each change in direction aids in reducing the exhaust flow velocity and thus, reduces the noise produced by the exhaust. Of course other constructions may include more or fewer baffles 57 or different arrangements of the baffles 57 to arrive at a flow pattern that is desirable.

For example, FIG. 7 illustrates another construction of the exhaust manifold 55*a* in which the first tube 60*a* extends through the exhaust manifold 55*a*. A plurality of apertures 195 are formed in the first tube 60*a* in the region disposed within the exhaust manifold 55*a*. Additional baffles 57 may also be positioned within the exhaust manifold 55*a* to direct the incoming exhaust as desired. As the flows reach and surround the first tube 60*a*, the exhaust flow enters the first tube 60*a* through the apertures 195.

From the outlet of the exhaust manifold 55, the flow of products of combustion enters the first tube 60, or continues to flow along the first tube 60*a* for constructions similar to that shown in FIG. 7, and flows substantially in a second direction 200 that is generally from the front of the enclosure 85 toward the rear of the enclosure 85. The first tube 60 ends in a T-connection with the second tube 65. As illustrated herein, the second tube 65 is substantially normal to the first tube 60 with other angles also being possible. As the engine exhaust flow enters the second tube 65, the flow is divided into two flow streams that generally flow toward the ends of the second tube 65 and away from one another. Thus, the engine exhaust flow makes a substantially 90 degree turn as it enters the second tube 65. The two flow streams exit the second tube 65 via the plurality of apertures 70 in the second tube 65 to define an exhaust flow 202. However, to exit through these apertures 70, the flows must make another 90-degree turn such that as the flows exit the second tube 65 they are flowing in the first direction 75, generally opposite the second direction 200.

The engine 15 also draws air from the engine chamber 125 using the engine fan 45 to produce a flow of engine cooling air 203. This air stream enters the engine chamber 125 by passing from the atmosphere through the engine aperture 165. The air then flows through the open top 155 of the air duct 140 and the slots 160 to enter the air duct space 150. The fan 45 draws the air from the air duct space 150 and directs the air over the engine cylinders 35 and other components to cool the engine components. After passing through the engine 15, the air flows toward and around the exhaust manifold 55, the first tube 60, and the second tube 65 where the air provides additional cooling to those components. The air flows generally in the second direction 200 from the front of the enclosure 85 toward the rear of the enclosure 85. After passing over the exhaust manifold 55, the first tube 60, and the second tube 65 the air exits the enclosure 85 via the outlet aperture 175.

During alternator operation, the fan 80 draws air from the space 100 and through the alternator passages to define a flow of alternator cooling air 205. As air is drawn from the alternator space 100 additional cool air flows in from the atmosphere through the alternator apertures 105 and into the alternator space 100. This arrangement assures that the alternator 20 receives a steady flow of cooling air and inhibits the intake of air that has passed through or around the engine 15. After the air exits the alternator 20, the air is directed upward toward the exhaust manifold 55. The air passes around the exhaust manifold 55, the first tube 60, and the second tube 65 to provide additional cooling for these components. Again, the air generally flows in the second direction 200 toward the rear of the enclosure 85 and the outlet aperture 175.

As discussed, the exhaust flow 202 exits the second tube 65 and flows in the first direction 75 toward the exhaust manifold 55, and the front of the enclosure 85. The engine cooling air 203 and the alternator cooling air 205 flow in generally the opposite direction toward the rear of the enclosure 85. As these three flow streams 202, 203, 205 mix, the exhaust flow 202 is eventually reversed and the exhaust flow 202, the engine cooling air 203, and the alternator cooling air 205 exit the enclosure 85 via the outlet aperture 175.

The numerous flow reversals established within the enclosure 85 serve to improve the cooling efficiency of the system, while simultaneously reducing flow velocities into, out of, and within the enclosure 85. The reduced flow velocities reduce the level of noise produced as the standby generator 10 operates. Furthermore, the additional cooling of the exhaust manifold 55, first tube 60, and second tube 65 further cools the engine exhaust beyond that which could be achieved without the flow of cooling air past the exhaust manifold 55, the first tube 60, and the second tube 65. The additional cooling further reduces the specific volume of the engine exhaust and thus, reduces the flow velocities within the exhaust manifold 55, the first tube 60, and the second tube 65. The reduced flow velocities reduce the noise produced by the flow. In addition, as the cooling flow streams mix with the exhaust flow 202, the exhaust flow 202 is further cooled. This cooling reduces the specific volume and flow velocity of the exhaust flow 202, thus further reducing the noise produced by the standby generator 10 as the air and exhaust flow 202 exit the standby generator 10. The reduced temperature of the exhaust flow 202 allows for the use of less expensive plastic materials for the outlet, shields, and other components exposed to the flow instead of engineered plastics or metal alloys.

It should be noted that each aperture described herein could include a plurality of separate openings that together define the aperture. Thus, the term "aperture" should not be interpreted as requiring that the aperture be a single continuous opening. Similarly, the term "opening" should not be interpreted as requiring that the opening be a single continuous hole or aperture.

Thus, the invention provides, among other things, a new and useful standby generator 10. More particularly, the invention provides a new and useful arrangement for the components within the enclosure 85 of a standby generator 10 that reduces the noise produced during operation of the standby generator 10.

What is claimed is:

1. An exhaust system for an engine that produces an exhaust gas during operation, the exhaust system comprising:

a manifold in fluid communication with the engine to receive the exhaust gas, and positioned within a cooling flow flowing in a first direction;

a conduit extending from the manifold in the first direction; and an outlet manifold coupled to the conduit and extending in a second direction substantially normal to the first direction, the outlet manifold defining an aperture oriented such that exhaust gas passes through the aperture and out of the exhaust system in a third direction that is substantially opposite the first direction, the exhaust gas mixing with the cooling flow.

2. The exhaust system of claim 1, further comprising a passageway that defines a passageway flow area and provides fluid communication between the manifold and the engine, the manifold defining a flow area that is larger than the passageway flow area.

3. The exhaust system of claim 2, further comprising a second passageway that defines a second passageway flow area and provides fluid communication between the manifold and the engine, wherein the manifold flow area is larger than the sum of the passageway flow area and the second passageway flow area.

4. The exhaust system of claim 1, further comprising a baffle positioned within the manifold to redirect the exhaust gas.

5. The exhaust system of claim 1, wherein the aperture includes a plurality of apertures spaced apart in the second direction along the outlet manifold.

6. The exhaust system of claim 1, wherein the exhaust gas passes through the aperture in the third direction toward the manifold.

7. The exhaust system of claim 1, further comprising an enclosure, the engine, the manifold, the conduit, and the outlet manifold disposed substantially within the enclosure.

8. The exhaust system of claim 1, wherein the conduit and the outlet manifold cooperate to define a substantially T-shaped portion having a base and two opposed arms, and wherein exhaust gas enters the T-shaped portion at the base and exits the outlet manifold through the two opposed arms such that the exhaust gas flows in the direction of the base.

9. The exhaust system of claim 1, wherein the cooling flow passes over the manifold in substantially the first direction.

10. An apparatus comprising:

an enclosure including a first aperture, a second aperture, and a third aperture;

a prime mover disposed within the enclosure and including an exhaust portion;

a first fan coupled to the prime mover and operable to draw a first flow of air into the enclosure through the first aperture, the first flow of air divided into a first flow stream and a second flow stream that passes over the exhaust portion; and a second fan coupled to the prime mover and operable to draw a second flow of air into the enclosure through the second aperture, the second flow of air passing over the exhaust portion and mixing with the first flow stream at a point where the second flow of air flows in a direction substantially opposite the first flow stream to at least partially define a third flow stream, the third flow stream exiting the enclosure through the third aperture.

11. The apparatus of claim 10, further comprising an electric machine disposed substantially within the enclosure and coupled to the prime mover, the electric machine operable to output electrical power in response to prime mover operation.

12. The apparatus of claim 10, wherein the prime mover includes an internal combustion engine.

13. The apparatus of claim 10, wherein the enclosure defines an inlet chamber positioned to receive the first flow of air from the first aperture, the inlet chamber including an air duct that divides the first flow of air into the first flow stream and the second flow stream.

14. The apparatus of claim 10, wherein the enclosure defines a front surface, a rear surface, a first side surface, and a second side surface, and wherein the first aperture is disposed in the front surface, the second aperture is disposed in the first side surface, and the third aperture is disposed in the rear surface.

15. The apparatus of claim 10, wherein the exhaust portion discharges a flow of exhaust gas in a first direction, and wherein the exhaust gas mixes with the second flow of air and the first flow stream to define the third flow stream.

16. The apparatus of claim 15, wherein the third flow stream exits the enclosure in a second direction substantially opposite the first direction.

17. An apparatus comprising:

an enclosure including a first aperture, a second aperture, and a third aperture;

a prime mover disposed within the enclosure and including an exhaust portion;

a first fan coupled to the prime mover and operable to draw a first flow of air into the enclosure through the first aperture, the first flow of air divided into a first flow stream and a second flow stream that passes over the exhaust portion; and a second fan coupled to the prime mover and operable to draw a second flow of air into the enclosure through the second aperture, the second flow of air passing over the exhaust portion and mixing with the first flow stream to at least partially define a third flow stream, the third flow stream exiting the enclosure through the third aperture, wherein the enclosure defines a front surface, a rear surface, a first side surface, and a second side surface, and wherein the first aperture is disposed in the front surface, the second aperture is disposed in the first side surface, and the third aperture is disposed in the rear surface, and wherein the second aperture includes a first opening and a second opening, the first opening passing through the first side surface and the second opening passing through the second side surface.

18. A method of operating an engine in an enclosure, the method comprising:

operating the engine to draw in a flow of air and to produce a flow of exhaust gas;

collecting the flow of exhaust gas within a manifold;

passing at least a portion of the flow of air over the manifold in a first direction;

directing the flow of exhaust gas to an outlet manifold;

discharging the flow of exhaust gas from the engine in a second direction substantially opposite the first direction;

mixing a portion of the flow of exhaust gas with the portion of the flow of air to define a mixture; and discharging the mixture from the enclosure.

19. The method of claim 18, further comprising dividing the flow of air into a combustion stream and a cooling stream.

20. The method of claim 18, further comprising coupling an electric machine to the engine and outputting electrical power from the electric machine in response to operation of the engine.

21. The method of claim 20, further comprising drawing a second flow of air into the enclosure in response to operation of the electric machine.

22. The method of claim 21, further comprising passing a portion of the second flow of air over the manifold, mixing the portion of the second flow of air with the mixture, and discharging the portion of the second flow of air and the mixture from the enclosure.

23. The method of claim 22, wherein the second flow of air and the mixture are discharged from the enclosure through a common outlet aperture.

24. The method of claim 23, wherein the outlet aperture includes a plurality of openings arranged adjacent one another.

25. The method of claim 18, further comprising discharging the exhaust gas from the outlet manifold in the second direction toward the manifold.

26. The method of claim 18, further comprising directing the exhaust gas along a length of the outlet manifold and discharging the exhaust gas through a plurality of discharge apertures.

* * * * *